US007389550B2

(12) United States Patent
Park

(10) Patent No.: US 7,389,550 B2
(45) Date of Patent: Jun. 24, 2008

(54) SANITARY SEAT COVER ASSEMBLY FOR TOILET BOWL

(76) Inventor: In-Ku Park, 104-3002 Hyundai I-Park, 9 Jeongja 1-dong, Bundang-gu, Seongnam-si, Gyunggi-do (KR) 463-811

( * ) Notice: Subject to any disclaimer, the term of this patent is extended or adjusted under 35 U.S.C. 154(b) by 0 days.

(21) Appl. No.: 10/528,204

(22) PCT Filed: May 11, 2004

(86) PCT No.: PCT/KR2004/001085

§ 371 (c)(1),
(2), (4) Date: May 2, 2005

(87) PCT Pub. No.: WO2005/058115

PCT Pub. Date: Jun. 30, 2005

(65) Prior Publication Data

US 2005/0283887 A1 Dec. 29, 2005

(30) Foreign Application Priority Data

Dec. 18, 2003 (KR) ..... 10-2003-0093456
Mar. 17, 2004 (KR) ..... 10-2004-0017957

(51) Int. Cl.
*A47K 13/14* (2006.01)
*A47K 13/24* (2006.01)

(52) U.S. Cl. ..... 4/244.1

(58) Field of Classification Search ..... 4/243.1–244.3, 4/245.1–245.9
See application file for complete search history.

(56) References Cited

U.S. PATENT DOCUMENTS

| | | | | | |
|---|---|---|---|---|---|
| 1,429,724 | A * | 9/1922 | Leon | 4/244.1 |
| 1,760,363 | A * | 5/1930 | Kann | 4/244.1 |
| 2,002,721 | A * | 5/1935 | Thomasma | 4/244.1 |
| 2,260,404 | A * | 10/1941 | Richardi | 4/245.3 |
| 4,766,618 | A | 8/1988 | Boker | |
| 4,850,061 | A * | 7/1989 | Engel | 4/245.4 |
| 4,979,237 | A * | 12/1990 | Hazar et al. | 4/244.1 |
| 4,998,297 | A | 3/1991 | Summerville | |
| 5,172,431 | A | 12/1992 | Rohde | |
| 5,590,424 | A | 1/1997 | Matsunaga et al. | |
| 6,006,370 | A * | 12/1999 | Wu | 4/244.3 |
| 6,058,518 | A * | 5/2000 | Akazawa | 4/245.4 |
| 6,212,693 | B1 | 4/2001 | D'Aleo | |
| 6,862,752 | B2 * | 3/2005 | Ohba | 4/245.4 |

* cited by examiner

*Primary Examiner*—Huyen Le
(74) *Attorney, Agent, or Firm*—Townsend and Townsend and Crew LLP

(57) ABSTRACT

A sanitary seat cover assembly to cover the surface of a seat with a clean sanitary seat cover at every use, the sanitary seat cover assembly including sanitary seat covers having a body part that covers the upper surface of the seat with a predetermined area range and a neck part extended and protruded correspondingly to a portion where the seat is hinged from the body part; a clamp for selectively fixing the neck part of the more than two sanitary seat covers piled and overlapped on one another at a portion where the seat is hinged; and a supporting frame for maintaining the shape of the sanitary seat covers.

2 Claims, 11 Drawing Sheets

SANITARY SEAT COVER ASSEMBLY FOR TOILET BOWL

This is a nationalization of PCT/KR04/001085 filed May 11, 2004 and published in English.

TECHNICAL FIELD

The present invention relates to a sanitary seat cover assembly for a toilet bowl where a new clean sanitary seat cover can be in use whenever a person's body is in contact with the surface of a seat of the toilet bowl.

BACKGROUND ART

In general, a toilet bowl has a structure in which a seat of the toilet bowl can be liftable to be in correspondence with a user's position, either standing or sitting.

At this time, the seat may be a medium to transfer various infectious germs like bacteria or virus as any person can use the seat. Besides, some harmful matters to irritate people's skin like cleansing detergents may remain on the surface of the seat. Because of such reasons, most users doubt the sanitation on the seat of the toilet bowl. In order to alleviate such untidiness or discomfort in uses of the toilet bowl, some users wipe or cover the surface of the seat with tissues.

The prior art in order to reduce the aforementioned inconvenience was to provide a plurality of sanitary seat covers tailored in the same shape as the seat of the toilet bowl. A user should take out one of the sanitary seat covers, put it on the surface of the seat of the toilet bowl and sit on it. In the prior art, the user is required to make an effort to arrange the sanitary seat cover precisely on the surface of the seat. In addition, the user should take a careful step to prevent the sanitary seat cover from sliding into the toilet bowl while sitting on it.

On the other hand, as another prior art in order to solve such inconvenience, there has been disclosed a structure having an adhesive interposed between the surface of the seat and the sanitary seat cover facing it. But, in this structure, it is difficult to separate the sanitary seat cover from the adhesive on the surface of the seat of the toilet bowl. The adhesive force may be weakened due to the repeatedly use of the adhesive against a plurality of sanitary seat covers in subsequent uses. There was another problem of causing physical displeasure to a user'skin with the presence of the adhesive and foreign matters stuck on the adhesive. Furthermore, since the adhesive is applied to one side of the surface of the sanitary seat cover, there were problems of increasing the processing steps and the manufacturing cost.

Another structure to prevent the slide-off of the sanitary seat cover is to make the sanitary seat cover enlarged greater than the surface of the seat with the extra portion of the sanitary seat cover fixed between the lower side of the seat and the upper body portion of the toilet bowl. According to the aforementioned structure, there were inconvenient required steps of arranging the sanitary seat cover with care, lifting the seat and inserting the extra portion to the respective positions.

On the other hand, the toilet bowl is generally placed in a rather wet environment and washed with water and cleansing solution. The sanitary seat cover is usually made of paper that is easily transformed by moisture. Therefore, the sanitary seat cover should be stocked over the height of the toilet bowl so as not to contact with water. Besides, the user should take steps of withdrawing one sanitary seat cover from the storage case, arranging the withdrawn sanitary seat cover correspondingly to the seat and re-fixing them together. While a sanitary seat cover is withdrawn from many orderly piled and overlapped sanitary seat covers in the storage case, one or more sanitary seat covers may be taken out thereby bring about unnecessary waste.

DISCLOSURE OF THE INVENTION

It is an object of the present invention to solve the aforementioned problems and provide a sanitary seat cover assembly for a toilet bowl that prevents damage of moisture while storing a pack of a plurality of sanitary seat covers close to the toilet bowl.

It is another object of the present invention to provide a sanitary seat cover assembly for a toilet bowl that improves convenience in use by letting a sanitary seat cover withdrawn from a storage case accommodating a plurality of sanitary seat covers set up properly at the surface of the seat of the toilet bowl.

It is still another object of the present invention to provide a sanitary seat cover assembly for a toilet bowl that can reduce unnecessary waste by letting only one sanitary seat cover utilized at each occasion.

Best Mode For Carrying Out The Invention

Hereinafter, according to preferred embodiments of the present invention to accomplish the aforementioned objects, a sanitary seat cover assembly for a toilet bowl, will be described in detail with reference to accompanying drawings.

Figure 1:
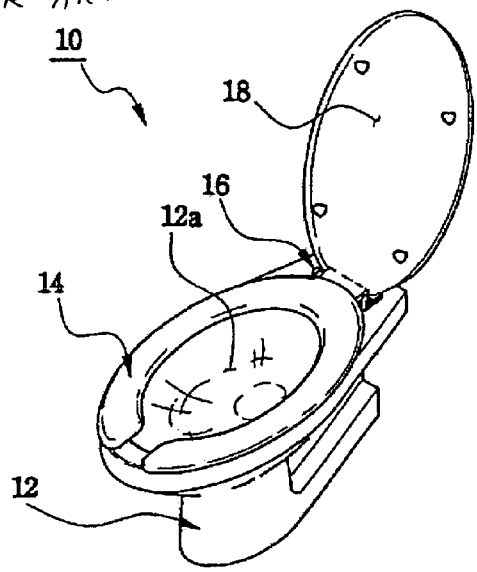
FiG.1 PRIOR ART
FIG. 1 is a perspective view illustrating a general toilet bowl.
Figure 2:
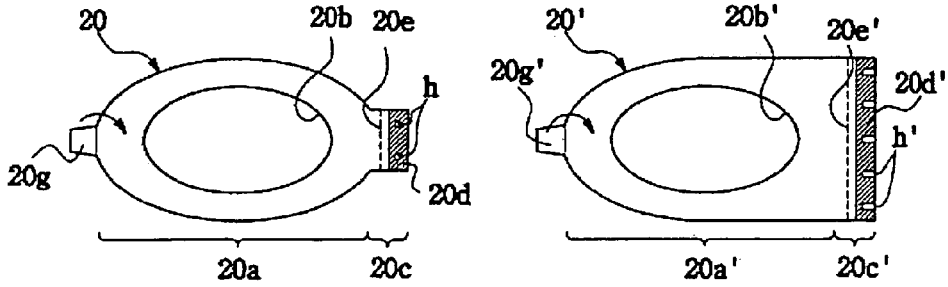
FIG. 2 is a schematic plane view illustrating a sanitary seat cover according to the present invention.
Figure 3:
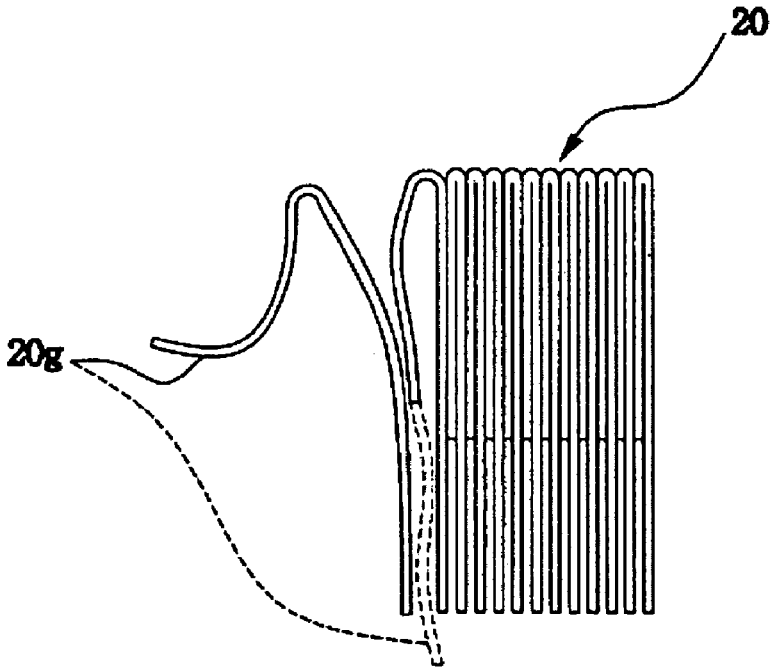
FIG. 3 is a cross-sectional view illustrating the state of a withdrawing grip when the sanitary seat covers are mounted altogether.

FIG. 1 is a perspective view illustrating a general toilet bowl, FIG. 2 is a schematic plan view illustrating the shape of the sanitary seat cover according to the present invention, FIGS. 3 through 19 are views illustrating sanitary seat cover assemblies according to the respective embodiments including the sanitary cover seat shown in FIG. 2. At this time, parts that perform identical or similar functions in the structure will be represented with identical reference numerals and additional descriptions will be omitted thereto.

First of all, the toilet bowl 10 shown in FIG. 1 has a main body 12 which is connected with a draining device and provided on the floor of a bathroom or restroom. In the upper center portion of the main body 12, a water storage part 12*a* that is formed in a concave shape and supplies water and shuts the flow of bad odor by getting the passage to the draining device shut with a certain amount of water is formed. A ring shaped seat 14 having a predetermined width is placed onto the external circumference of the top of the water storage part 12*a*. At this time, the seat 14 is hinged to a hinge part 16 at a rear portion of the main body 12 for lifting. A lid 18 of the toilet bowl is hinged with the seat 14 in the hinge part 16 for selectively covering the top of the seat 14.

As shown in FIG. 2, sanitary seat cover 20, 20' according to the embodiment of the present invention having the aforementioned structure are divided into body part 20*a*, 20*a'* shaped to cover the top surface of the seat 14 and neck part 20*c*, 20*c'* extended to the direction of the hinged part 16, that is, to the direction of getting the seat 14 hinged from the body part 20*a*, 20*a'* to the seat 14.

At this time, the body part 20*a*, 20*a'* of the sanitary seat cover 20, 20' has area enough to cover the surface of the seat 14. In addition, the center portion of the body part 20*a*, 20*a'* has cut part 20*b*, 20*b'* correspondingly to the internal edges of the seat. Such cut part 20*b*, 20*b'* has diameter smaller than that of internal edge of the seat 14. In other words, the remaining body part 20*a*, 20*a'* other than the cut part 20*b*, 20*b'* has shapes to sufficiently cover the surface of the seat 14 with area greater than the seat 14. The cut part 20*b*, 20*b'* can be tailored from the body part 20*a*, 20*a'* in the course of forming the sanitary seat cover 20, 20'. Furthermore, the cut part 20*b*, 20*b'* can be formed with partial cut lines depending on areas to be selected and separated conveniently from the body part 20*a*, 20*a'* by a user.

In addition, the body part 20*a*, 20*a'* includes withdrawing grip 20*g*, 20*g'* protruded outside from the edge of the body part 20*a*, 20*a'*. At this time, it is preferable that the withdrawing grip 20*g*, 20*g'* be formed opposite to the neck part 20*c*, 20*c'* with respect to the center of body part 20*a*, 20*a'*. Moreover, the withdrawing grip 20*g*, 20*g'* can be formed in the shape which is extended from the body part 20*a*, 20*a'*. Separate grip-shaped ones can be connected to the edge of the body part 20*a*, 20*a'*. In addition, as marked with a dot line in FIG. 3, the withdrawing grip 20*g*, 20*g'* can be formed with the length extending from the edge of the body part 20*a*, 20*a'* to the range of the cut part 20*b*, 20*b'*.

On the other hand, as shown in FIG. 2, the neck part 20*c*, 20*c'* of the sanitary seat cover 20, 20' have a compressed part 20*d*, 20*d'* having its edge and other sanitary seat cover 20, 20' which are bond to each other by sewing or other means. Besides, cutting lines 20*e*, 20*e'* are made between the compressed part 20*d*, 20*d'* of the neck part 20*c*, 20*c'* and the body part 20*a*, 20*a'* to separate the body part 20*a*, 20*a'* from the compressed part 20*d*, 20*d'* with a certain level of pulling force.

Hereinafter, the reference numerals marked with "'" in the structure of each sanitary seat cover will be omitted for convenience.

On the other hand, as shown in FIGS. 3 through 19, a plurality of the aforementioned sanitary seat covers 20 are piled in the same shape. The piled sanitary seat covers 20 are formed into a pack bound by a general binder 22 to the compressed part 20*d*.

In the pack of sanitary seat covers 20, each withdrawing grip 20*g* is tightly stuck to the surface of the extended or connected body part 20*a* and hidden by the sanitary seat covers positioned in front. As the next withdrawing grip 20*g* is exposed by separating the sanitary seat cover 20 positioned in front, it becomes possible to withdraw only a single sanitary seat cover. Another structure of such a withdrawing grip (not shown here) may be constructed with a predetermined area of plain paper at the edge of the body part 20*a*. A general connecting tool like a hook or string may be used to be in connection with each sanitary seat cover 20 and kept hidden until another sanitary seat cover 20 put in front of it is withdrawn out. Such a pack of sanitary seat cover 20 is connected to the hinge part 16, supported by supporting frames 30, 40, 40', 50, 70 of the sanitary seat covers that cover up the upper portion of the seat 14 in accordance with the rotating position, and maintains its shape.

Now, a description will be made about the structure of each embodiment of a binder 22 that forms a pack of the aforementioned sanitary seat covers 20.

Figure 18:
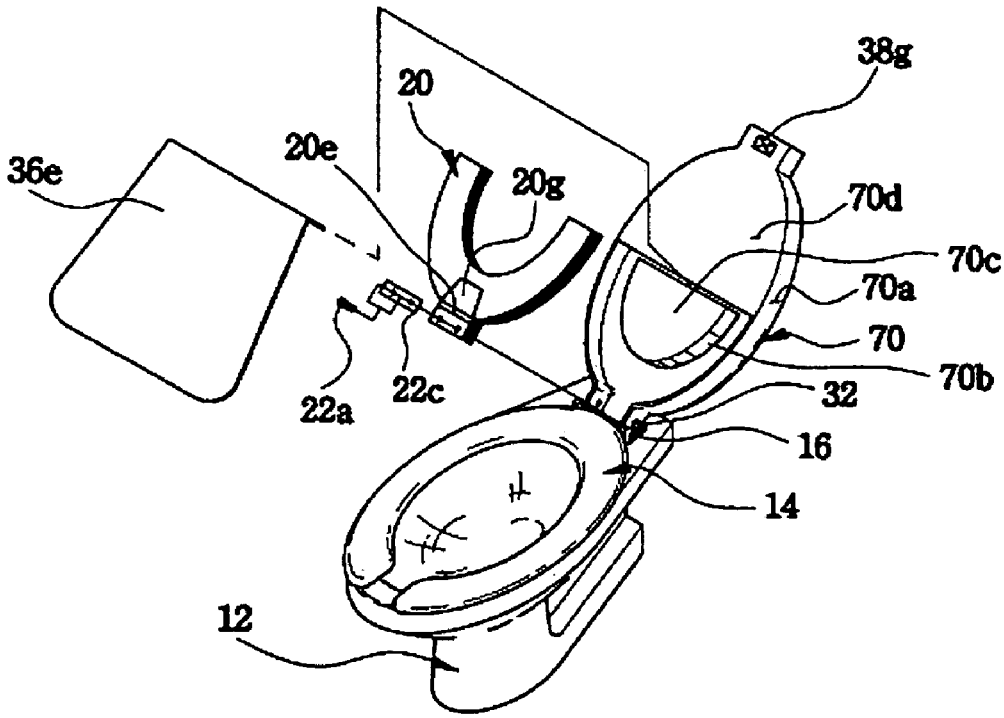
FIGS. 18 and 19 are exploded perspective views illustrating a sanitary seat cover assembly when the sanitary seat cover is folded.
Figure 19:
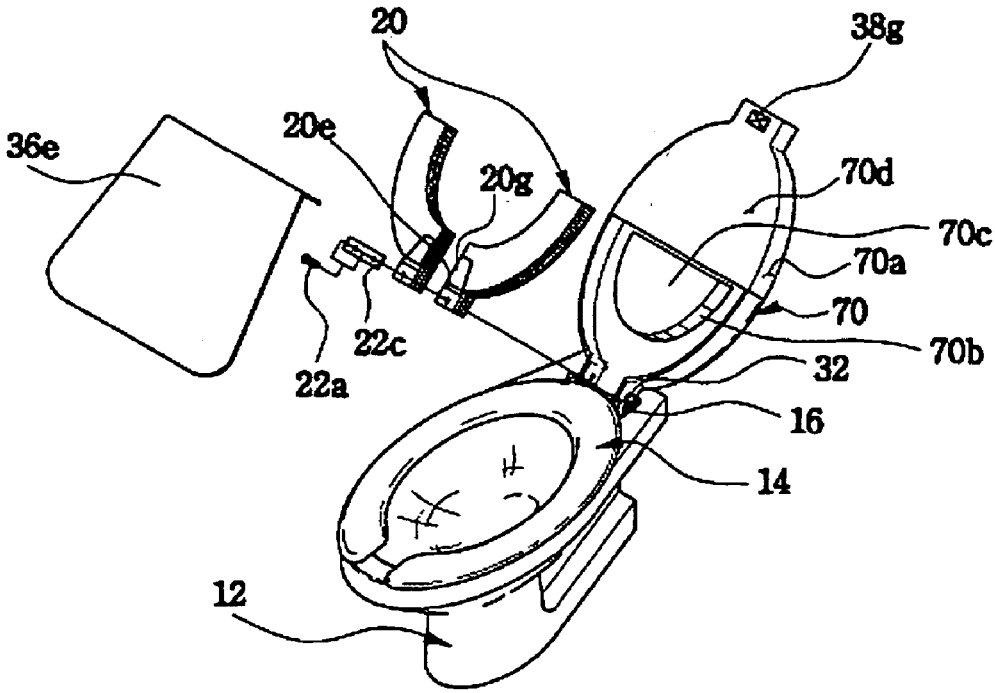

First of all, one embodiment of the binder 22 is constructed with bolts 22*a*and nuts 22*b'* compressed and screwed through the sanitary seat covers 20 to the supporting frame 30, 40, 40', 50, 70 with the neck parts 20*c* of the sanitary seat covers 20 aligned properly. Such a binder 22 may be constructed by forming nuts 22*b'* on the supporting frame 30, 40, 40', 50, 70 and passing bolts 22*a* through the pressing part 20*d* of the sanitary seat covers 20 in opposite to the nuts 22*b'*. The binder 22 of the bolts 22*a* and nuts 22*b* may be also constructed by placing the bolts 22*a* on the supporting frame 30, 40, 40', 50, 70, screwing the nuts 22*b'* at the edge of the bolts 22*a* that pass through sanitary seat cover 20 and forcibly fix the sanitary seat cover 20 between them by applying pressure. At this time, the connection between the bolts 22*a* and nuts 22*b'* performs functions of binding the sanitary seat covers 20 and cramping the sanitary seat covers 20 against the supporting frame 30, 40, 40', 50, 70. In addition to the structure of the binder 22,a pressing plate 46 may be included so as to increase the local pressure between the bolts 22*a* and nuts 22*b'* to the area range of pressing part 20*d* as shown in FIG. 18 or 19. As shown in FIG. 2, it is preferable that a through hole (h) to let the bolts pass through the piled state of the pressing parts 20*d* or a hole (h') cut from the edge may be additionally formed on the sanitary seat covers 20 that correspond to the aforementioned structure of the binder 22 having bolts 22*a* and nuts 22*b*.

Figure 4:
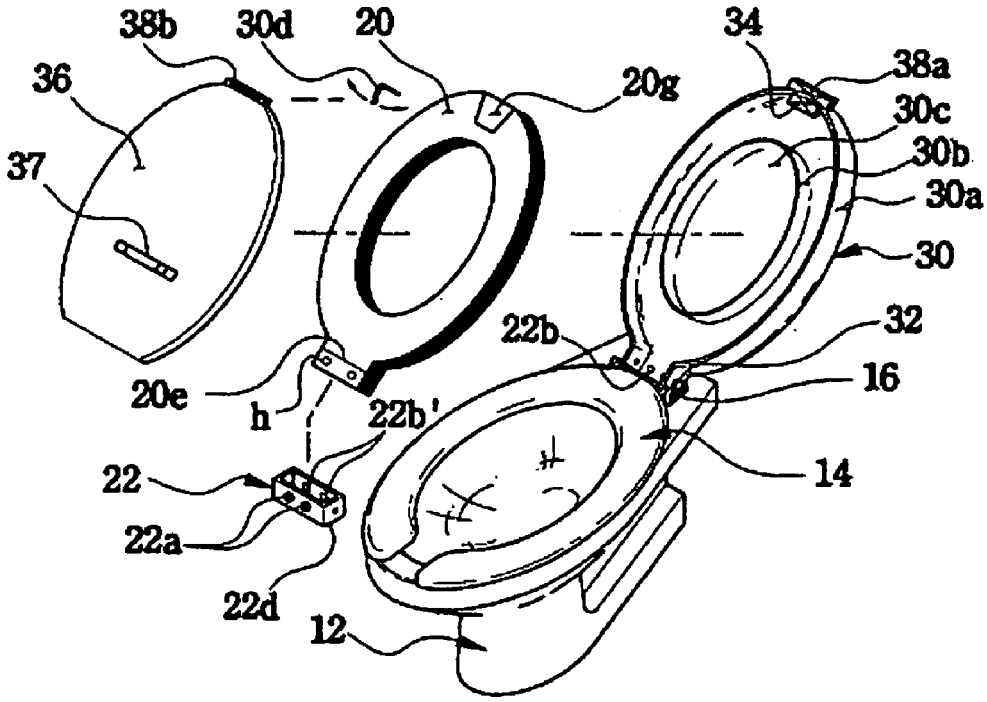
FIG. 4 is a perspective view illustrating a sanitary seat cover assembly for a toilet bowl according to the present invention.

As shown in FIG. 4, another embodiment of the binder 22 may be constructed with a case 22*d* where the pressing part 20*d* of sanitary seat covers 20 is pressed and inserted by a separate gig (not shown here). If the gig is eliminated later, the internal wall of the case 22*d* will restrict the elastic recovery of the pressing part 20*d*, thereby resulting in binding with a certain level pressure. In the aforementioned structure, bolts 22*a* and nuts 22*b'* may be screwed in the case 22*a* through which the pressing parts 20*d* of sanitary seat covers 20 are passed. Even if not shown here, other means like a general band or clip may be used as the binder 22.

On the other hand, the supporting frame 30, 40, 40', 50, 70 for sanitary seat cover 20 may further include a clamp 32 for supporting the neck part 20*c* of the sanitary seat covers which are bound into a pack. As shown in FIGS. 4 through 8*c*, the embodiment of the clamp 32 is illustrated in a structure of pressing or hitching both sides of the pack of sanitary seat covers 20. As shown in FIGS. 9 through 11*c*, 15 and 17, the clamp 32 may be formed into a groove to make the bound portion of the sanitary seat cover 20 inserted in one direction (for instance, from top to bottom). As shown in FIGS. 11*a* through 12, particularly in FIG. 12, the clamp 32 fixed or supported by insertion of the pressing part 20*d* of sanitary seat covers 20 may be formed with a protrusion protruded from the lateral walls that correspond to the pressing part 20*d*of sanitary seat cover 20 on the supporting frame 40. The clamping function of the 32 made into a groove or protrusion is to maintain the position of the neck part 20*c* of sanitary seat cover 20 while each sanitary seat cover is separately withdrawn out to the other direction (for instance, to the front), correspondingly to the seat 14. The neck part 20*c* of the sanitary seat cover 20 separated from its pack is held by the clamp 30*a*, and the body part of the sanitary seat cover 20 is arranged onto the seat 14. Besides, the aforementioned clamp 32 has a function of fixing the position of the remaining sanitary seat covers 20 including the neck part 20*c* against the physical reaction when the neck part 20*c* is pulled away along its cutting line after the sanitary seat cover 20 is used.

On the other hand, another embodiment of the clamp 32 has a pressing plate 46 in which the binder is tightly placed to the pressing part 20*d* of sanitary seat covers 20, which are piled by the binder described above. The clamp of the supporting frame 30,40,40', 50, 70 corresponding to the pressing plate 46 is constructed with a band lever having a hook and a lever respectively linked on the lateral walls of the supporting frame 30,40,40', 50, 70, where the pressing plate 46 is placed, and the band lever forcibly fixes the pressing part 20*d* of the sanitary seat cover 20 by getting the linked hook tightly compressing the pressing plate 46 to the supporting frame 30,40,40', 50, 70 according to changes in rotational angles of the lever. At this time, the structure of the clamp 32 using the band lever is similar to the art where a binder 22 is generally used for binding sanitary seat cover 20. The structure of the band lever as such will be omitted because the structure is constructed to close a container. Another structure of the clamp 32 may be constructed with a clip (omitted here for simplification of the drawings) that elastically presses the neck part of the sanitary seat cover 20 bound into a pack.

On the other hand, a detailed description will be made about the supporting frame 30, 40, 40', 50, 70 for sanitary seat cover with reference to accompanying drawings of FIGS. 4 through 19.

First of all, the supporting frame 30,40,40', 50,70 for sanitary seat cover comprise external frame 30*a*, 40*a*, 40*a*', 50*a*', 70*a*' formed in the shape of plates facing one side of a pack of sanitary seat cover to thereby surround the edge of the sanitary seat cover 20. At this time, internal frame 30*b*, 40*b*, 40*b*', 50*b*, 70*b* is additionally included in the center of the supporting frame 30, 40, 40', 50, 70 in correspondence to cut center of the sanitary seat cover 20 so as to cover the internal edge of the sanitary seat cover 20. Besides, an internal region formed by the internal frame 30*b*, 40*b*, 40*b*', 50*b*, 70*b* may be used as an accommodation space for various things like cushion, paper, books, newspapers. In addition, one or more hitching jaw 30*d* may be included on the external frame 30*a*, 40*a*, 40*a*', 50*a*, 70*a* or the internal frame 30*b*, 40*b*, 40*b*', 50*b*, 70*b* over or beside the supporting frame 30, 40, 40', 50, 70 for supporting the position of sanitary seat cover 20 fixed by a binder. Such hitching jaw 30*d* is to keep the binding state of sanitary seat cover 20 stuck on the internal surface of the supporting frame 30, 40, 40', 50, 70 while the supporting frame 30, 40, 40', 50, 70 is rotated to cover the top of the seat 14.

The structure of the hitching jaw 30*d* shown in FIGS. 4 through 12 may be used as a plate-spring or a general pressing tool (not shown here) using elasticity of a spring while the spring is fixed at the external frame 30*a*, 50*a* of the supporting frame 30, 50 to elastically press the surface of the sanitary seat cover 20 correspondingly. In addition, the aforementioned hitching jaw 30*d* is preferably mounted on the supporting frame 30, 50 for sanitary seat cover. It is preferable that the hitching jaw 30*d* is constructed to horizontally rotate without disturbance of sanitary seat cover 20. It is preferable that a pushing elastic part 34 be additionally mounted at the internal surface of the supporting frame 30, 50 facing the hitching jaw 30*d* to make a withdrawing grip 20*g* continuously remaining in contact with the hitching jaw 30*d*.

Moreover, it is preferable that furrows f1, f2 be formed to prevent moisture remaining on the lateral walls facing the internal and external edges of sanitary seat cover 20 from being induced inside and getting in contact with the sanitary seat cover 20.

On the other hand, as shown in FIGS. 4 through 11*c* and FIGS. 18 and 19, the supporting frame 30, 40, 40', 50, 70 additionally include coverlets 36, 36*a*, 36*b*, 36*c*, 36*d*, 36*e*to protect sanitary seat cover 20 from outside moisture.

Figure 5:
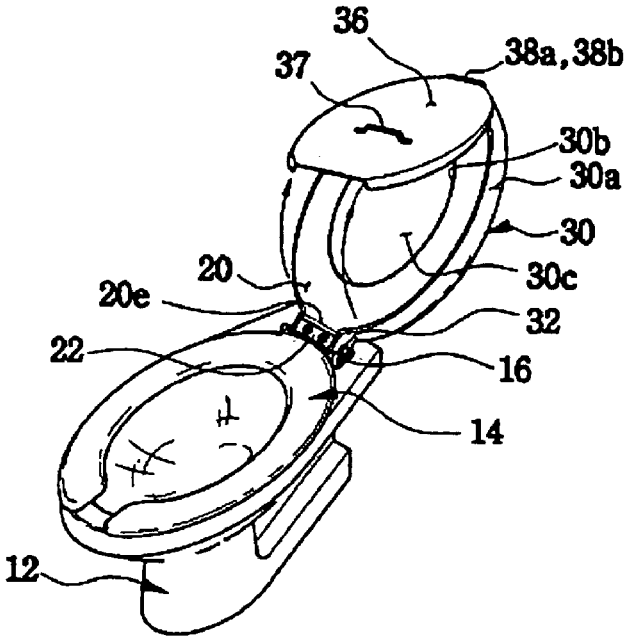
FIG. 5 is a perspective view illustrating an assembled state of the structure shown in FIG. 4.
Figure 6:
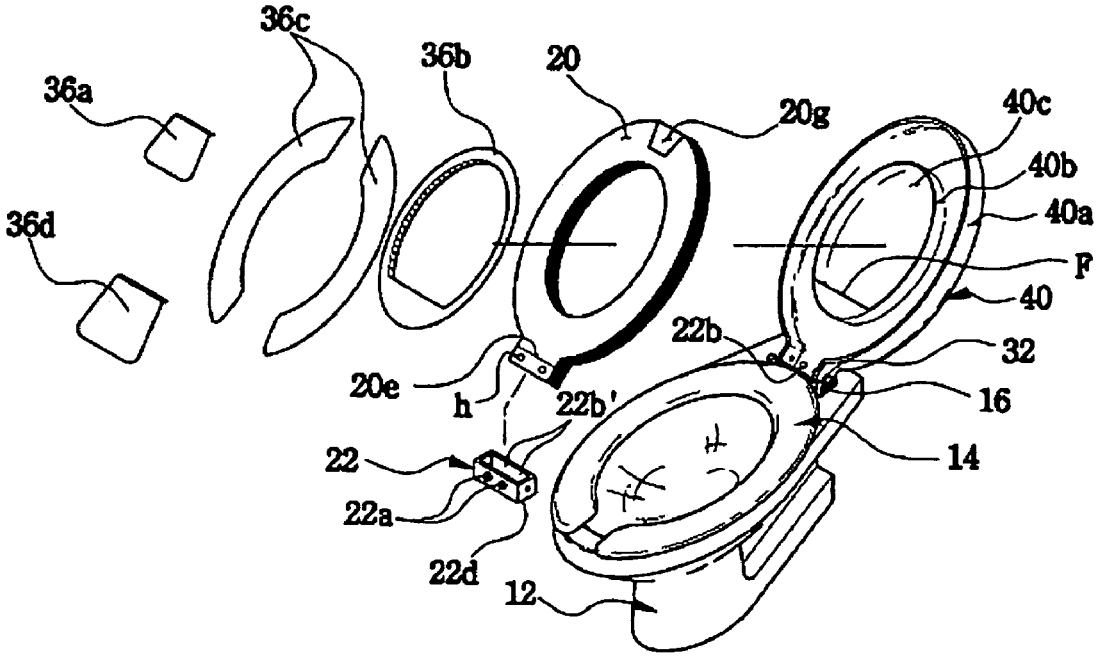
FIG. 6 is an exploded perspective view illustrating another application of a lid of the toilet bowl illustrated in FIG. 4.
Figure 7:
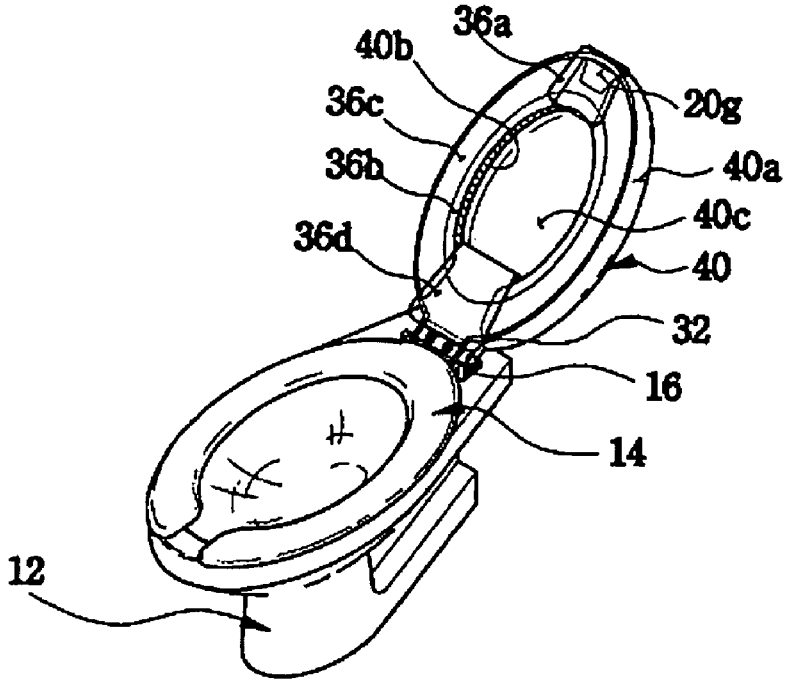
FIG. 7 is a perspective view illustrating an assembled state of the structure shown in FIG. 6.

The coverlet 36 shown in FIGS. 4 and 5 is shaped in a plate to cover the front side of the supporting frame 30 and the external edge, where the sanitary seat covers are mounted, and hinged with connectors 38*a*, 38*b* at the upper portion of the supporting frame 30. Besides, the coverlet 36 may be made of flexibly bending synthetic resin including vinyl-products and welded to the supporting frame 30.

On the other hand, other coverlets 36*a*, 36*b*, 36*c*, 36*d* are shown in FIGS. 6 through 11*c*. The first coverlet 36*a* is fixed to the upper portion of the external frame 40*a* of the supporting frame 40 to extensively cover up the internal frame 40*b* with a predetermined area. Besides, the second coverlet 36*b* is extended to a predetermined width to the external frame 40*a* along the internal frame 40*b* of the supporting frame 40. The third coverlet 36*c* is extended with a predetermined width to the internal frame 40*b* at both sides of the external frame 40*a*. In addition to them, the fourth coverlet 36*d* is extended to the lower portion of the supporting frame 40 from the lower portion of the internal frame 40*b*. The respective coverlets 36*a*, 36*b*, 36*c*, 36*d* are overlapped one another with a predetermined width, and they are made of a flexible material that can be bent when the sanitary seat cover is withdrawn.

Figure 8A:
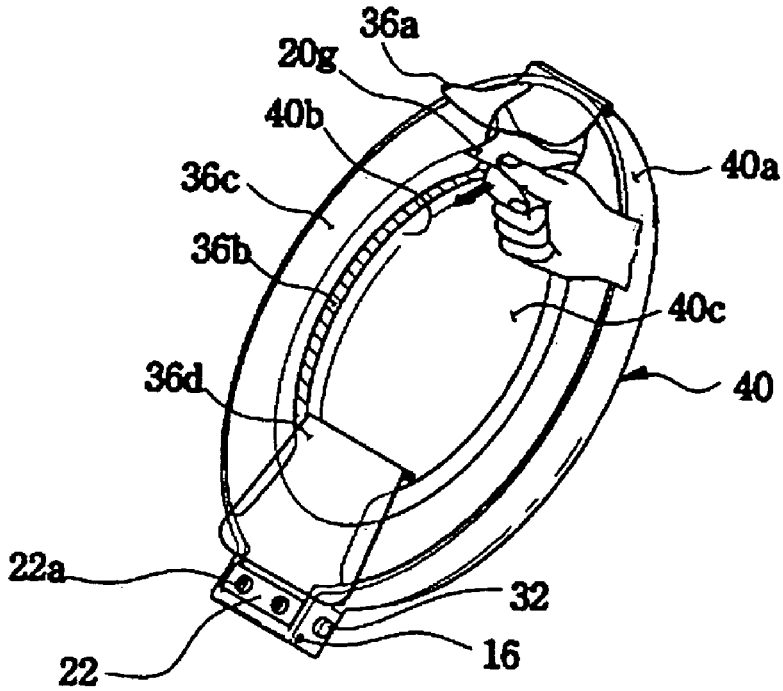
FIGS. 8*a* through 8*c* are perspective views illustrating steps of withdrawing a sanitary seat cover in the structure of FIG. 6.
Figure 8B:
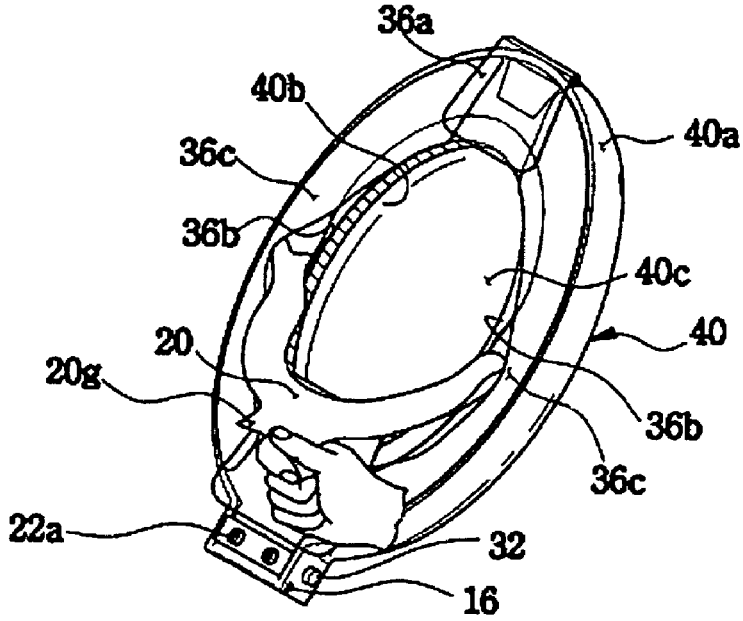
Figure 8C:
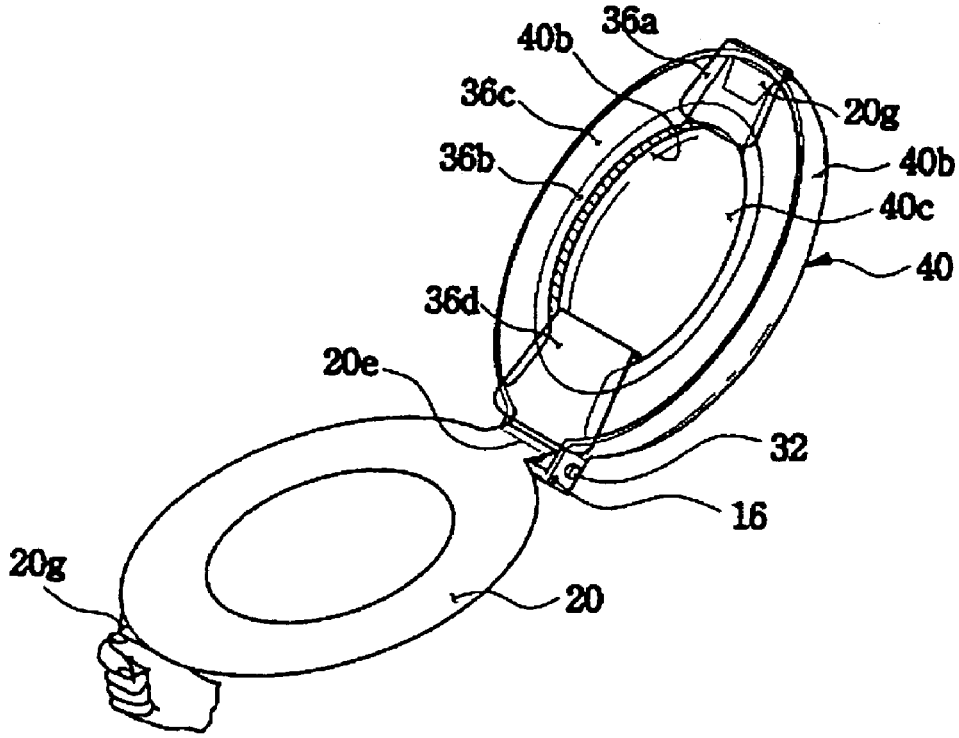

FIGS. 8*a* through 8*c* illustrate the steps of withdrawing a sanitary seat cover 20 in the structure of the coverlets 36*a*, 36*b*, 36*c*, 36*d*. First of all, a user holds the withdrawing grip 20*g* stuck or fold and exposed at the surface of the body part 20*a* of the sanitary seat cover 20 while lifting up the first coverlet 36*a* and then snatches to the direction of an arrow. At this time, the sanitary seat cover 20 connected to the withdrawing grip 20*g* passes through the third coverlet 36*c* while stretching the third coverlet 36*c* out and transforms the shape of the second coverlet 36*b*. As shown in FIG. 8*b*, the sanitary seat cover 20 which is withdrawing is withdrawn through the second and third coverlets 36*b*, 36*c* that are opened by the withdrawing sanitary seat cover 20. As shown in FIG. 8*c*, the sanitary seat cover 20 is arranged in the shape corresponding to the seat 14 of the toilet bowl 10 through the bottom of the fourth coverlet 36*d*. In the process of those steps, the aforementioned coverlets 36*a*, 36*b*, 36*c*, 36*d* are to be recovered to the original shape where all the coverlets are overlapped with a predetermined width. At this time, the portion of the coverlets overlapped one another is naturally tightened to prevent permeation of outside moisture and transformation of sanitary seat covers 20 due to a contact with moisture.

A factor to be considered in the structure of such coverlets 36*a*, 36*b*, 36*c*, 36*d* is the inconvenience in mounting the sanitary seat covers 20 for replacing to the supporting frame 40. In order to solve such a problem, auxiliary frames 42*a*, 42*b* may be added detachably in the shape where a cut is made at a certain portion of the external frame 40*a* that fixes the first and third coverlets 36*a*, 36*b* among all the coverlets. Besides, there may be another structure to solve the aforementioned problem by constructing detachably the edge of the external frame 40*a* against the supporting frame 40. There may be still another structure to solve the aforementioned problem by constructing the external frame 40*a* having the first and third coverlets 36*a* formed detachably against the supporting frame 40.

FIGS. 9 through 11*c* are modified embodiments where sanitary seat cover 20 is easily mounted to the structure of the coverlets 36*a*, 36*b*, 36*c*, 36*d*.

Figure 9:
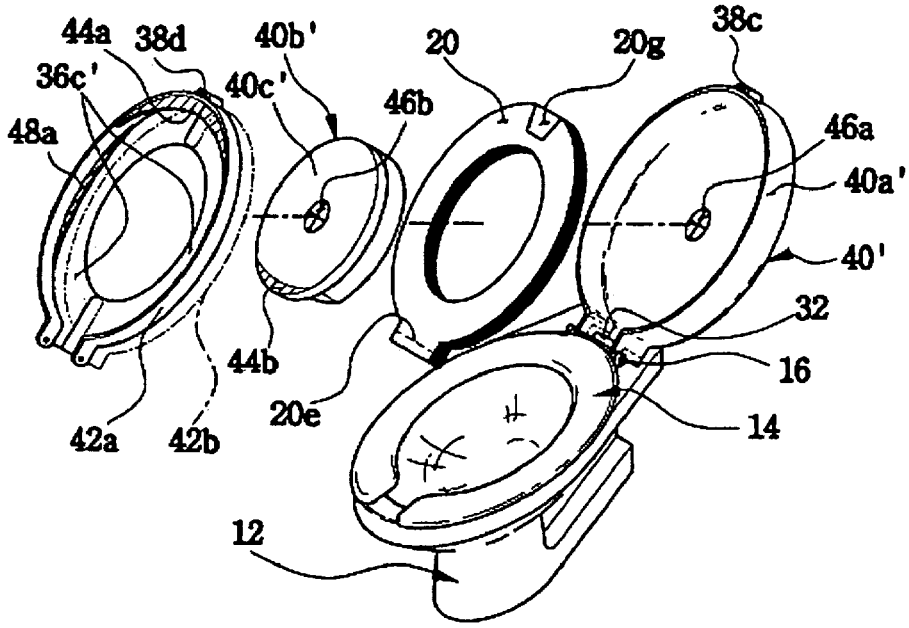
FIGS. 9 and 10 are exploded perspective views illustrating respective applications of the lid.

Above all, as shown in FIG. 9, an auxiliary frame 42*a* shaped with a cut in its thickness to the direction of the piled sanitary seat cover 20 placed on the supporting frame 40' may be constructed to be attached or detached from the external frame 40*a*'. In such an auxiliary frame 42*a*, a coverlet 36*c*' extended and transformed from the aforementioned third coverlet 36*c* is fixed at both edges of the auxiliary frame 42*a*. Then, the coverlet 36*c*' may be selectively fixed at either front or back of the auxiliary frame 42*a*. Furthermore, the auxiliary frame 42*b* marked by an imaginary line in FIG. 9 has a separate structure in which the external frame 40*a* can be attached or detached from the aforementioned supporting frame 40'. At this time, the coverlet 36*c*' may be fixed along the front or middle in the thickness direction of the auxiliary frame 42*b*.

The coverlet 36*c*' may replace the structure of the aforementioned first, second and fourth coverlets 36*a*, 36*b*, 36*d* because coverlet 36*c* to be overlapped at the top and bottom of the supporting frame 40' of the sanitary seat covers 20. At this time, the edge of the coverlet 36*c* ' preferably made in contact with the lateral wall of the internal frame 40*c*' mounted at the supporting frame 40. In addition, a guard 48*a* is separately added at the center of both sides of the auxiliary frames 42*a*, 42*b* to expand the area of fixing the coverlet 36*c*' and to support the position of the sanitary seat cover 20 correspondingly to the rotational position of the supporting frame 40' at the same time. Besides, the guard 48*a* is formed in an arc so as to minimize the hitching function when the sanitary seat cover 20 is withdrawn out of the coverlet 36*c*'. At this time, the fixing area of the coverlet 36*c*' may be restricted to the range of area occupying the guard 48*a*. In addition, the aforementioned auxiliary frames 42*a*, 42*b* are preferably made correspondingly to the hinge part 16 or the supporting frame 40' as rotated around the hinge part 16. General connectors 38*c*, 38*d* may be additionally included at one or more portions corresponding to the auxiliary frames 42*a*, 42*b* and the supporting frame 40' to selectively maintain mutual connection. When the fixing position of the coverlet 36*c*' is back or middle in thickness direction of the auxiliary frames 42*a*, 42*b*, the gap between the front side of the auxiliary frames 42*a*, 42*b* and the coverlet 36*c*' should be as big as an area where the seat 14 can be rotated and inserted.

As shown in FIG. 11*a* another factor to be considered in insertion of the seat 14 is to have a distance d between the back edge of the seat 14 from the hinge part 16 and the position of the pressing part 20*d* of sanitary seat cover 20. When the sanitary seat cover 20 is formed with an area identical to the seat 14, the distance d brings about a result of exposing the front side of the seat 14 and the back of the internal edge of the seat 14. Therefore, the sanitary seat cover 20 is formed with a range of area further extended in correspondence with the distance d. It is preferable that blinders 44*a*, 44*b* extended down from the top of the auxiliary frames 42*a*, 42*b* and the bottom of the internal frame 40*b*' at the position exposed by insertion of the seat 14 into the auxiliary frames 42*a*, 42*b* with a certain depth. Then, the internal frame 40*b*' is constructed to be selectively attached or detached from the supporting frame 40'. General fasteners 46*a*, 46*b* are respectively included at the supporting frame 40' and the internal frame 40*b*' for selective fastening.

Figure 10:
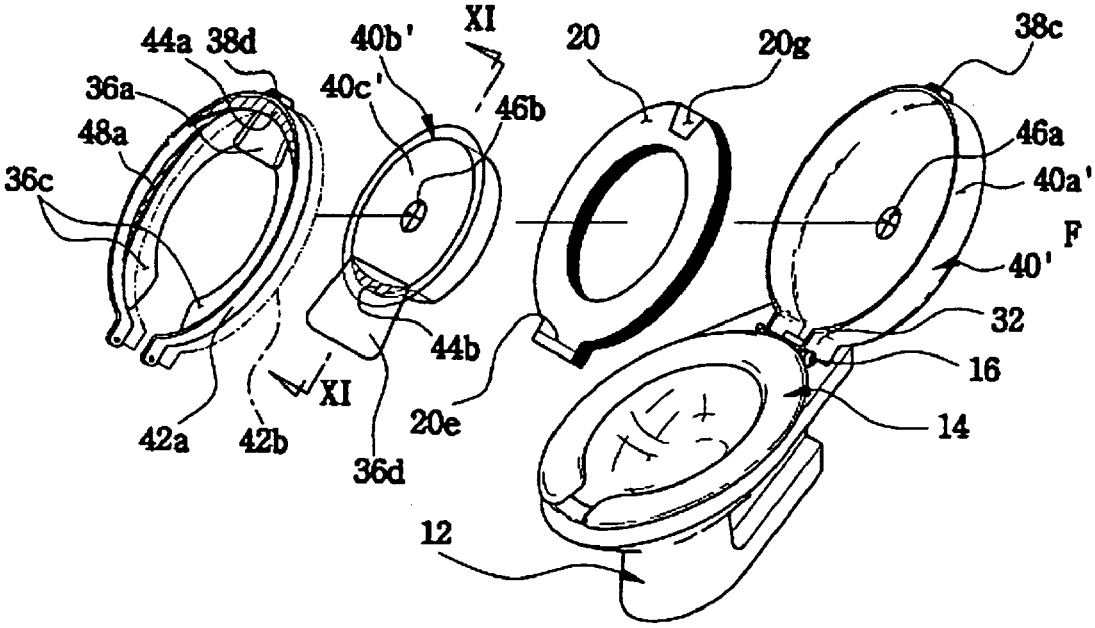
Figure 11A:
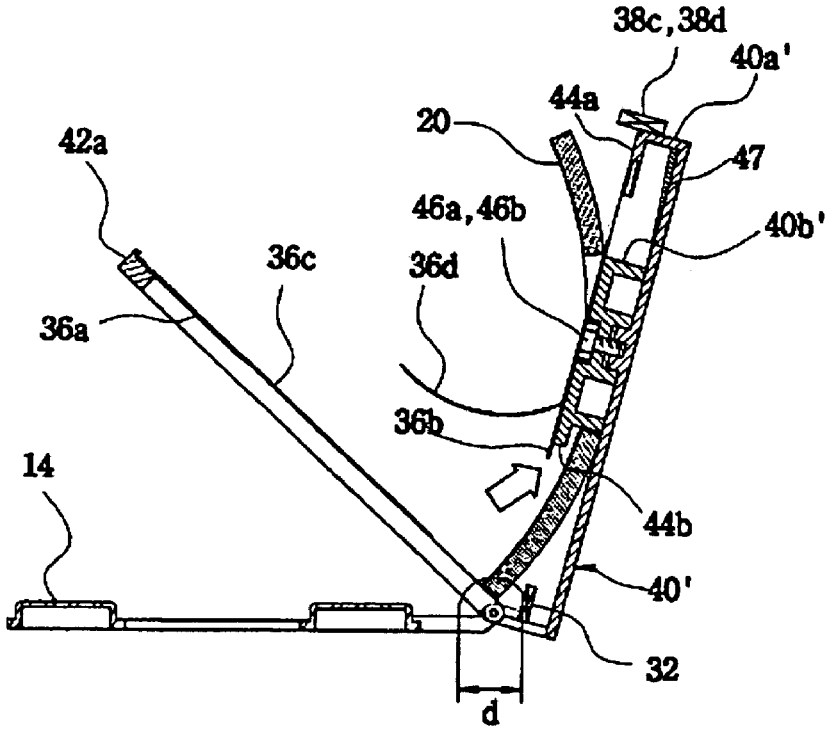
FIGS. 11*a* through 11*c* are cross-sectional views illustrating operational relationship in the structure of FIG. 10.
Figure 11B:
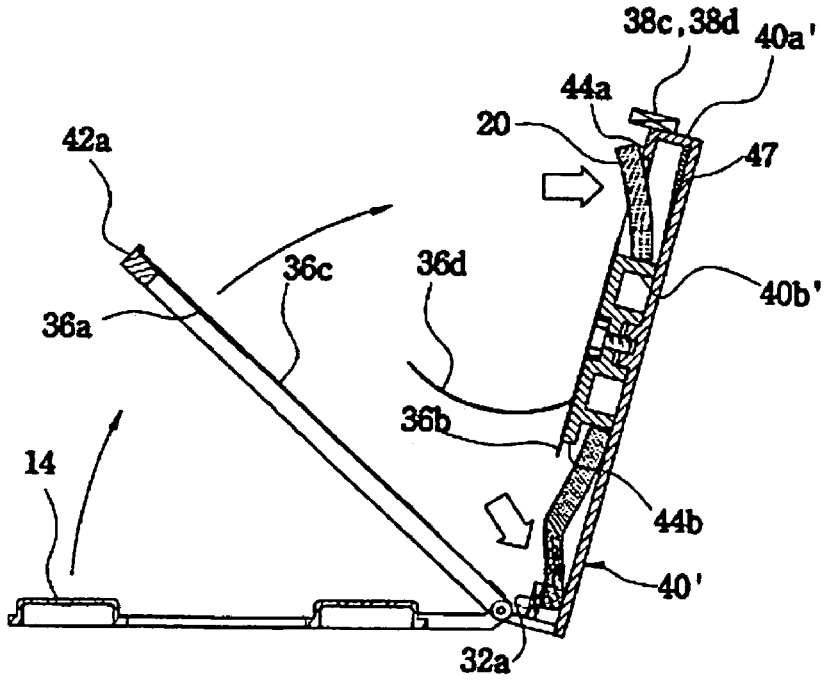
Figure 11C:
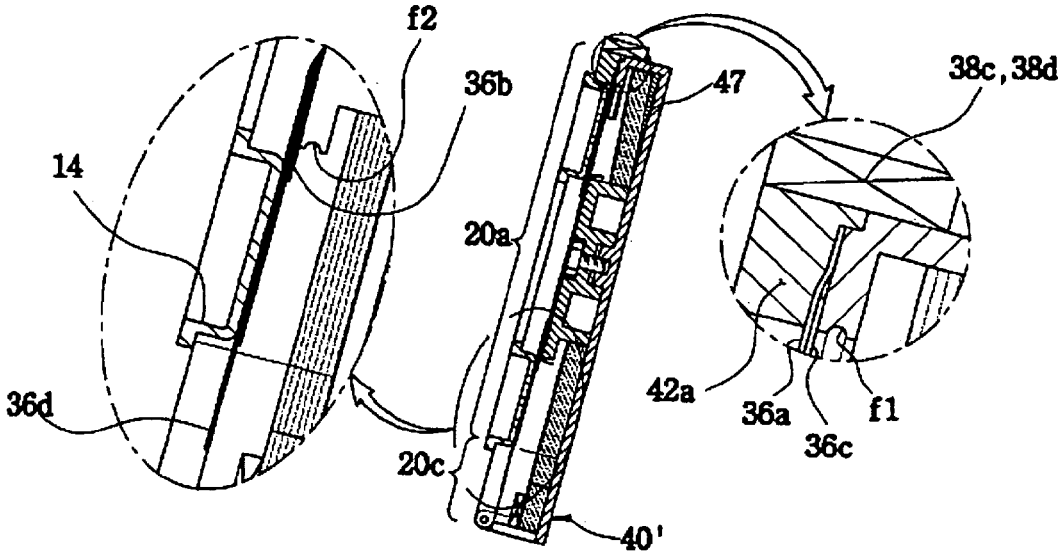
Figure 12:
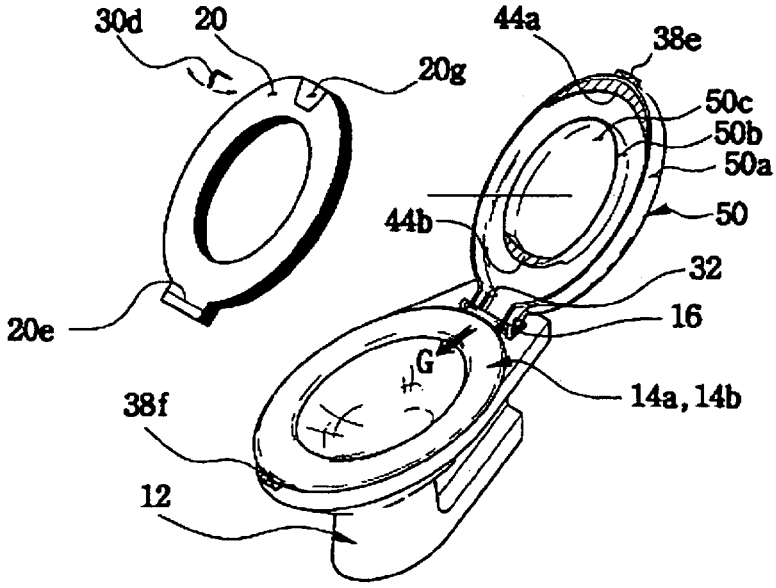
FIG. 12 is an exploded perspective view illustrating another embodiment of the present invention.

The structures shown in FIGS. 10 through 11*c* are embodiments of the coverlets 30*a*, 30*b*, 36*c*, 36*d* of the auxiliary frames 42*a*, 42*b* described above. At this time, the first and third coverlets 36*a*, 36*c* are fixed along the front and back edge of the auxiliary frames 42*a*, 42*b*. Besides, the second and fourth coverlets 36*b*, 36*d* are mounted on the internal frame 40*b*'. As shown in FIG. 11*c*, the position of the second coverlet 36*b* on the internal frame 40*b*' can be elastically recovered as a pack of sanitary seat covers 20 are inserted with a sufficient depth.

FIGS. 11*a* and 11*b* illustrate steps of mounting a pack of sanitary seat covers 20 shown in FIG. 10. First of all, as shown in FIG. 11*a*, the auxiliary frames 42*a*, 42*b* are released from the supporting frame 40', and the sanitary seat cover 20 is placed to let the fourth coverlet 36*d* pass through the cut part 20*b* of the pack of the sanitary seat covers 20. Then, the cut part 20*b* of the sanitary seat cover 20 is inserted correspondingly into the blinder 44*b* of the internal frame 40*b*. As shown in FIG. 11*b*, the neck part 20*c* of the sanitary seat covers 20 is fixed by the clamp 32 which is formed on the supporting frame 40'. As shown in FIG. 11*c*, the top of the sanitary seat covers 20 is inserted into the other blinder 44*a* of the external frame 40*a*'. Subsequently, the sanitary seat covers 20 are inserted between the external and internal frames 40*a*', 40 *b*' to let the second coverlet 36*b* pass through the cut part 20*b* of the sanitary seat covers 20 and be exposed to the front. Then, the auxiliary frames 42*a*, 42*b* are fastened with connectors 38*c*, 38*d* to the external frame 40*a*', and the fourth coverlet 36*d* is protruded to the front of the third coverlet 36*c*.

As compared with it, in the structure where the internal frame 40*b*' is separable, the neck part of the sanitary seat covers 20 is fixed by the clamp 32 of the supporting frame 40'. Then, a step of inserting the internal frame 40*b*' into the cut part 20*b* of the sanitary seat covers 20 and connecting it with supporting frame 40' and another step of fastening the auxiliary frames 42*a*, 42*b* to the external frame 40*a*' are performed regardless of the sequence. At this time, the first and fourth coverlets 36*a*, 36*d* are exposed to the front of the third coverlet 36*c*; the fourth coverlet 36*d* is close to the surface of the sanitary seat covers 20 from the innermost side; and the third coverlet 36*c* is arranged and overlapped at the front of the fourth coverlet 36*d* with a predetermined width. The positions of all the coverlets are easily recovered during the step of withdrawing a sanitary seat cover 20 positioned to the front. It is preferable that an elastic piece 47 is additionally included on the supporting frame 40', where the withdrawing grip 20*g* of the sanitary seat cover 20 is positioned, to push and continue to keep the withdrawing grip 20*g* protruded from the front, as FIGS. 11*a* through 11*c*.

Figure 13:
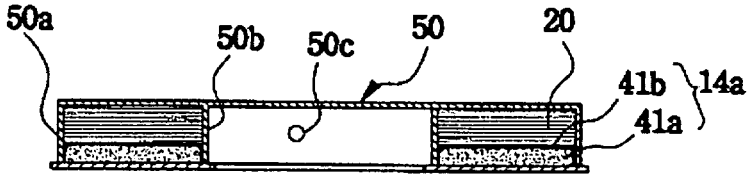
FIGS. 13 and 14 are cross-sectional views illustrating respective embodiments of the fastening relationships between a supporting frame of a sanitary seat cover and a seat of a toilet bowl shown in FIG. 12.
Figure 14:
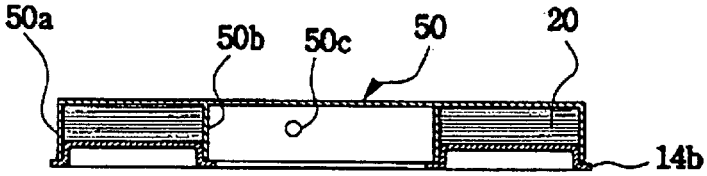

On the other hand, as shown in FIGS. 12 through 14, the seat 14 is inserted into the supporting frame 50 to prevent permeation of outside moisture. The internal and external edges 50*a*, 50*b* of the supporting frame 50 and the seat 14 are combined to maintain the shape of the sanitary seat covers 20 and that of the internal and external edges of the sanitary seat covers 20. The internal and external frames 50*a*, 50*b* of the supporting frame 50 for maintaining the shape of the sanitary seat covers 20 are made it possible to let the seat 14 rotated, inserted and attached along the external wall of the internal frame 50*b* and the internal wall of the external frame 50*a*, thereby keeping the sanitary seat covers 20 in a closed state. FIG. 13 is an embodiment of the structure to keep the aforementioned sanitary seat covers 20 in the closed state. The sanitary seat cover 20 should have a seat 14*a* with durability, strong enough not to get any transformation caused by a load when a user sits on the portion of the sanitary seat cover 20 on the main body 12 of the toilet bowl. It is preferable that the internal and external edges of the seat 14*a* are greater in width than the internal gap of the seat 14*a*, wide enough to be stretched to the edge of the internal and external frames 50*a*, 50*b* of the supporting frame 50. Besides, a cushion part 41*a* is placed on the seat 14*a*, as shown in FIG. 13, so that the shape of the cushion part 41*a* can be flexibly transformed within the range of width to fit between the internal and external frames 50*a*, 50*b* of the supporting frame 50 and that the seat 14*a* including the cushion part 41*a* is covered with a somewhat soft material of an outer layer part 41*b*. In the aforementioned structure, the cushion part 41*a* and outer layer part 41*b* are inserted into the internal and external frames 50*a*, 50*b* of the supporting frame 50, thereby getting tightly stuck to its surface. The state of being tightly stuck plays a function of stopping permeation of any possible outside moisture. At this time, the connection between the seat 14*a* and supporting frame 50 is elastically transformed while the cushion part 41*a* of the seat 14*a* is inserted between the internal and external frames 50*a*, 50*b* of the supporting frame 50, thereby forming the tight attachment to its lateral wall. However, such a structure described above may be equipped or constructed differently. The cushion part 41*a* and the outer layer part 41*b* are formed in a size of being smoothly inserted into the supporting frame 50, the edge of the seat 14*a* is tightly stuck to the internal and external frames 50*a*, 50*b* of the supporting frame 50. Connectors 38*e*, 38*f* are respectively mounted at the edges facing each other for pulling or hitching functions. Besides, when the sanitary seat covers 20 are connected with each other in order to use one by one, the thickness of piled sanitary seat covers 20 becomes smaller. Therefore, an elastic piece 56*e* is additionally included at a position of the supporting frame 50 corresponding to the withdrawing grip 20*g* of the sanitary seat cover 20 to elastically push to the front for easy holding of the withdrawing grip 20*g*. The aforementioned connectors 38*e*, 38*f* may be constructed by screwing with general magnetic, hook button, hook, bolt and nut. On the other hand, the seat 14*b* shown in FIG. 14 is inserted between the internal and external frames 50*a*, 50*b* of the supporting frame 50, and the internal and external edges are formed in a shape of being expanded to a predetermined width, wide enough to reach out correspondingly to the end of the external and internal edges. The aforementioned seat 14*b* may be generally made in the molding method. At this time, the aforementioned blinders 44*a*, 44*b* may be additionally constructed at the internal and external frames 50*a*, 50*b* of the supporting frame 50 for sanitary seat covers.

Hereinafter, the procedure of utilizing the aforementioned structure will be described. First of all, a user separates the seats 14*a*, 14*b* from the supporting frame to sit on. The user pulls the grip of sanitary seat covers 20 exposed outside from the supporting frame 50 and places it on the surface of the seats 14*a*, 14*b* at the same time for use.

Other factors to be considered in addition to the aforementioned structure are to make an easy process of withdrawing sanitary seat covers 20 one after another while the seat 14 is being separated from the supporting frame 50 and to make a stable support of the remaining sanitary seat covers with the supporting frame 50. FIGS. 12 through 17 illustrate the structure of supporting the remaining sanitary seat covers 20 with the supporting frame 50 when a sanitary seat cover 20 is withdrawn out.

FIG. 12 illustrates a structure constructed with one or more hitching jaws 30*d* on the lateral wall of the internal and external frames 50*a*, 50*b* of the supporting frame 50. Such hitching jaws 30*d* are to keep the state of supporting sanitary seat covers 20 correspondingly to the rotational position of the supporting frame 40 as described above with reference to FIG. 4.

Figure 15:
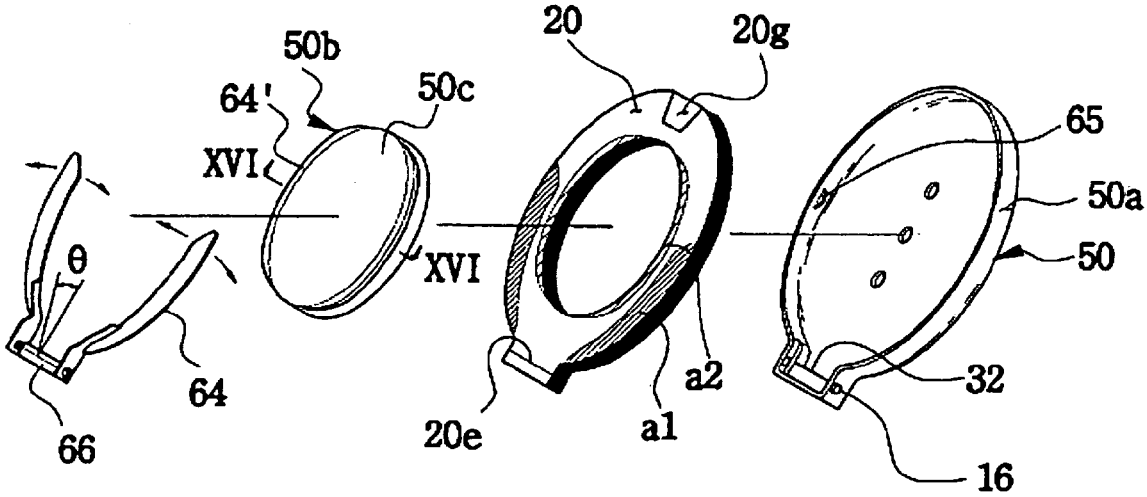
FIG. 15 is a perspective view illustrating the structure of an embodiment of a guard that supports a sanitary seat cover.
Figure 16:
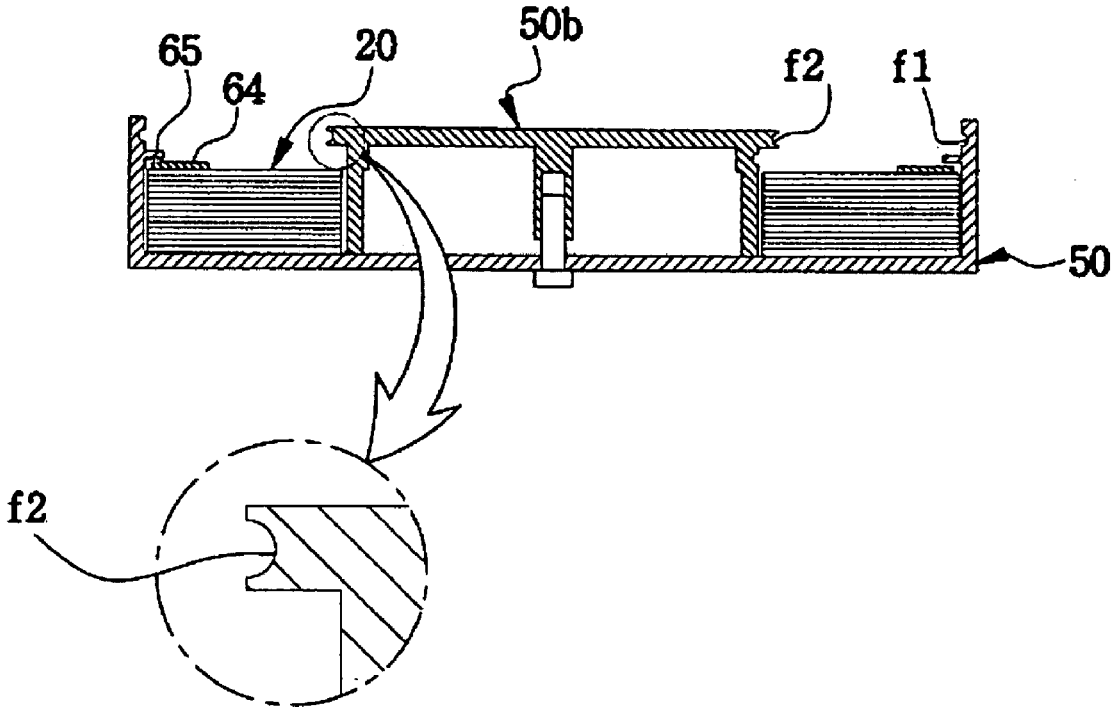
FIG. 16 is a cross-sectional view taken along the line XVI-XVI shown in FIG. 15.
Figure 17:
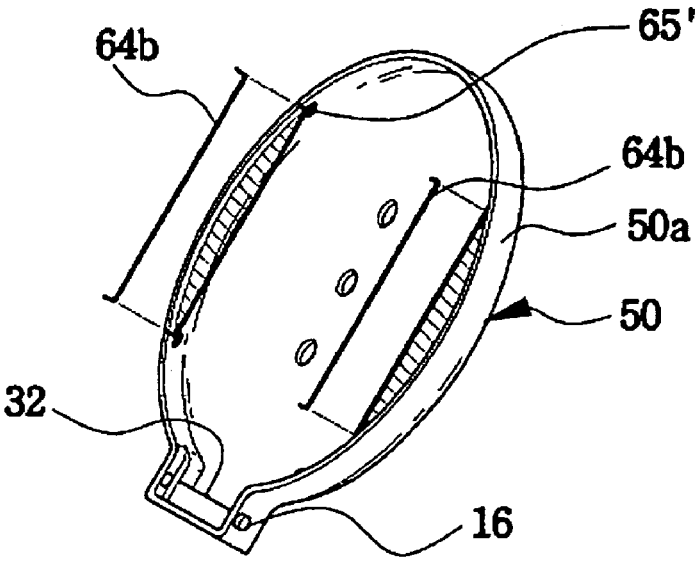
FIG. 17 is an exploded perspective view illustrating a transformed embodiment of a guard shown in FIG. 15.

FIGS. 15 and 16 illustrate another structure of supporting the positional state of sanitary seat covers 20 with a guard 64 that is hinged at the hinging portion of the supporting frame 50 and closely placed correspondingly to the edge within a range of not covering the neck part 20*c* of the sanitary seat covers 20. At this time, a supporting rod 66 to support both guards 64 presses or releases the neck part 20*c* of sanitary seat covers 20 according to the rotational position to perform a function as a selective binder or clamp. The aforementioned supporting rod 66 may be constructed with elastic means to get the guard 64 connected to the supporting rod 66 in an elastic contact with the supporting frame 50. It is preferable that the guard 64 be constructed to accommodate the seat 14 in the internal side of the supporting frame 50 and restrict its insertion depth. Besides, it is preferable that the supporting rods 66 be constructed to form a gap within a range of preventing the guards 64 from covering the neck part 20*c* of sanitary seat covers 20 at least. Besides, it is preferable that the guards 64 be constructed to easily withdraw sanitary seat covers 20 by making the area (a1) corresponding to both edges of sanitary seat covers 20 small. Auxiliary guards 64' are additionally mounted at the edges of the internal frame 50*b* to assist the aforementioned guards 64 to be in correspondence to the area range (a2) around the cut part 20*b* of sanitary seat covers 20. Furthermore, in order to stably support the sanitary seat cover 20 against the supporting frame 50, jaw 65 is preferably formed at the internal wall of the external frame 50*a* and the external wall of the internal frame 50*b* to restrict the rotation of the guards 64. As shown in FIG. 17, the guard 64*b* has a plurality of edge jaws 65' at both sides, and a rubber band, another elastic causing flexible transformation from its specific original one or a wire to be held or hinged to the external frame 50*a* may be included between the edge jaws 65'.

On the other hand, as shown in FIG. 18 or 19, in another embodiment of the structure depending on a different shape of the bound sanitary seat covers 20, the sanitary seat covers 20 are piled with its top portion folded with the bottom of the neck part 20*c* from the center of the body part 20*a* and with withdrawing grip 20*g* folded to its opposite direction. The neck part 20*c* of the piled sanitary seat covers 20 is pressed and fixed by the aforementioned binder 22 as described above. The supporting frame 70 may be formed correspondingly to the half-folded shape of the sanitary seat covers 20. Therefore, the supporting frame 70 is divided into two portions, the top of which is preferably used as an accommodating part 70*d* to store another replaceable pack of sanitary seat covers 20. Besides, a general connector 38*g* may be additionally included at the top portion to keep storing another replaceable pack of sanitary seat covers in its stored state. In addition, it is preferable that an additional cover 36*e*be included over the supporting frame 70 to prevent the sanitary seat covers 20 from being exposed outside moisture in the natural environment.

As shown in FIG. 19, according to another shape of a pack of sanitary seat covers 20, both longitudinal sides leading to the neck part 20*c* and withdrawing grip 20*g* including the center of the body part 20*a* are folded each other. At the aforementioned state, the top and bottom portions are folded again. Then, the folded withdrawing grip 20*g* is exposed from the surface of the sanitary seat covers 20 folded into one quarter of its original shape. The external portion of a plurality of sanitary seat covers 20 are piled and forcibly fixed by the binder.

In the structure described above, the sanitary seat covers 20 may be made of a paper, textile or synthetic vinyl product, and the supporting frame 50 may be replaced with the coverlet of the toilet bowl that covers the top of the seat 14 of the toilet bowl.

As described above, there are advantages in the aforementioned embodiments of the present invention in that a plurality of sanitary seat covers 20 covering the top surface of the seat 14 are protected from permeation of outside moisture by coverlets 36, 36*a*, 36*b*, 36*c*, 36*d*, 36*e*, that the neck part 20*c* of the withdrawn sanitary seat cover 20 is fixed by a binder to be easily arranged on the surface of the seat 14 and to be easily pulled and cut out along the cut line 20*e* after use, thereby making the following users replace sanitary seat covers conveniently.

Even though not illustrated in drawings, when the front portion of the seat 14 open-ended, or when the grip part of sanitary seat covers 20 is exposed with the seat 14 tightly stuck to the supporting frame, each sanitary seat cover 20 is withdrawn at the step of separating the seat 14 from the supporting frame 40.

INDUSTRIAL APPLICABILITY

According to the invention, there are effects as follows: a plurality of sanitary seat covers placing over the surface of the seat are prevented from outside frame; each sanitary seat cover is arranged on the surface of the seat because the neck part is fixed by the binder or cramp; the used sanitary seat cover is easily pulled and cut out along the cut line to make other users replace the sanitary seat covers conveniently; the withdrawing grip is provided for sanitary and convenient uses.

The invention claimed is:

1. A sanitary seat cover assembly for a toilet bowl seat, said sanitary seat cover assembly comprising:

sanitary seat covers having a body part covering a top surface of the seat with a predetermined area range and a neck part corresponding to a portion where the seat is hinged by a part of the seat; and a supporting frame for maintaining the shape of the sanitary seat covers, the support frame having a clamp, wherein the clamp selectively fixing the neck part of the sanitary seat covers at the part where the seat is hinged, wherein the supporting frame includes an external frame to cover around an edge of the sanitary seat covers in a shape of a plate facing one side of the sanitary seat covers fixed by the clamp, wherein the external frame being selectively attached or detached from the supporting frame and the external frame detachably including an auxiliary frame having a portion cut to a depth in a piling direction of the seat covers, and coverlets being fixed along at least one of a front, a center in a width direction and a back side of the auxiliary frame, wherein the auxiliary frame being rotated around a hinged portion of the supporting frame, wherein additional coverlets is mounted over the supporting frame of the sanitary seat covers to selectively cover an external portion of the sanitary seat covers along with the supporting frame, thereby preventing the sanitary seat covers from being exposed to an outside humid environment, and wherein the coverlets comprise four coverlets: a first coverlet fixed at the external frame; a second coverlet extended with a predetermined width in a direction of the external frame; a third coverlet extended with a predetermined width in a direction of an internal frame along the external frame; and a fourth coverlet extended to a bottom of the supporting frame from a bottom of the internal frame, and respective coverlets are overlapped one with another at a predetermined width and are made of a material that is flexibly transformed when the sanitary seat covers are withdrawn.

2. A sanitary seat cover assembly for a toilet bowl seat, said sanitary seat cover assembly comprising:

sanitary seat covers having a body part covering along a top surface of the seat with a predetermined area and a neck part corresponding to a portion where the seat is hinged at a part of the seat; and a supporting frame for maintaining the shape of the sanitary seat covers, the support frame having a clamp, the clamp selectively fixing the neck part of the sanitary seat covers at the part where the seat is hinged, coverlets mounted over the supporting frame of sanitary seat covers to selectively cover an external portion of the sanitary seat covers along with the supporting frame, thereby preventing the sanitary seat covers from being exposed to an outside humid environment, the coverlets including four coverlets: a first coverlet fixed at the external frame; a second coverlet extended with a predetermined width in a direction of the external frame; a third coverlet extended with a predetermined width in a direction of an internal frame along the external frame; and a fourth coverlet extended to a bottom of the supporting frame from a bottom of the internal frame, and respective coverlets being overlapped one with another at a predetermined width and being made of a material that is flexibly transformed when the sanitary seat covers are withdrawn out.

* * * * *